United States Patent [19]

McMaster

[11] 4,141,008

[45] Feb. 20, 1979

[54] ENERGY-RESPONSIVE INTRUDER DETECTION SYSTEM

[75] Inventor: Richard L. McMaster, Rochester, N.Y.

[73] Assignee: Detection Systems, Inc., Fairport, N.Y.

[21] Appl. No.: 862,662

[22] Filed: Dec. 21, 1977

Related U.S. Application Data

[63] Continuation of Ser. No. 782,840, Mar. 30, 1977, abandoned.

[51] Int. Cl.[2] ..... G08B 19/00

[52] U.S. Cl. ..... 340/533; 340/541; 340/565

[58] Field of Search ..... 340/253 R, 258 A, 258 B, 340/258 D, 258 R, 276, 416, 409; 328/133

[56] References Cited

U.S. PATENT DOCUMENTS 3,111,657 11/1963 Bagno ..... 340/258 A

*Primary Examiner*—Alvin H. Waring

*Attorney, Agent, or Firm*—Warren W. Kurz

[57] ABSTRACT

A shielded two-wire cable used to transmit signals from one or more remote receivers to a central signal processing unit in an energy-responsive system is simultaneously used to transmit from the signal processing unit to the receivers (a) a signal proportional to the system noise level, (b) a pulsating signal when the system noise exceeds a level indicative of a desired margin of safety, and/or (c) a steady-state signal when an alarm signal is generated by the signal processing unit.

8 Claims, 2 Drawing Figures

ENERGY-RESPONSIVE INTRUDER DETECTION SYSTEM

This is a continuation, of application Ser. No. 782,840, filed Mar. 30, 1977, now abandoned.

BACKGROUND OF THE INVENTION

This invention relates to energy-responsive systems, such as intruder detection systems, of the type which sense an occurrence of a condition, such as the presence of an intruder, in a region monitored by the system by sensing a predetermined change in the energy received by the energy-sensing component of the system. More particularly, this invention relates to improvements in energy-responsive systems of the type in which one or more energy-sensitive receivers transmits a condition-modulated electrical signal along a cable to a remote signal processing unit.

A so-called "multihead" intruder detection system comprises a plurality of intruder-sensing elements or receivers positioned at various locations in a relatively large space which is to be monitored for intrusion. Each receiver is sensitive to a particular type of energy (e.g., acoustic, infrared, microwave, etc.) which can be produced or modulated by the entrance of an intruder into the protected space, and each receiver is adapted to transmit electrical signals, proportional to the energy received, to a remote central processing unit which serves to process the electrical signals to determine whether the information contained thereby is indicative of the presence of an intruder. Typically, such signals are transmitted to the processing unit on a two-wire shielded cable known as a "shielded pair".

In installing multihead intruder detection systems, one often finds it useful to be able to monitor the system noise level as each receiver is connected to the system, inasmuch as the noise level is related to the number and placement of the receivers. Ideally, there should be a predetermined margin of safety between the system noise level and the threshold level at which an alarm is ultimately sounded to indicate the presence of an intruder. Because the signal processing unit is usually located some distance from most of the receivers, the installer must either rely on someone stationed at the processing unit to advise him when the desired margin of safety is reached or, alternatively, he must have a test cable which extends back to the control unit so that he can monitor, by a voltmeter or the like, the system noise level. Both of these approaches, of course, have certain obvious drawbacks. While this noise signal could be transmitted to each remote receiver by adding one or more additional wires to the cable which links the receivers with the central processing unit, this approach is undesirable from an economic standpoint.

Some commercially available multihead intruder detection systems have an indicating lamp in each receiver and comprise means for energizing such lamp when the particular receiver in which the lamp is mounted detects the presence of an intruder. It is known to transmit a lamp-energizing signal from the central processing unit to the receiver. While it is desirable for an installer to know when the system trips in response to the condition of interest, it also would be useful to have an indication when the system noise exceeds a predetermined margin of safety. No prior art system incorporates such a feature or, for that matter, the feature of being able to monitor the system noise at each remote receiver without the need for additional wiring beyond the shielded pair.

SUMMARY OF THE INVENTION

According to the invention, the shielded two-wire cable used to transmit signals from one or more receivers to a signal processing unit spaced therefrom is simultaneously used to transmit from the signal processing unit to the receiver (a) a signal proportional to the system noise, (b) a pulsating signal when the system noise exceeds a level indicative of a desired margin of safety, and/or (c) a steady-state signal when an alarm signal is generated by the signal processing unit. An indicator, preferably a light-emitting diode, positioned at the receiver is responsive to such pulsating and steady-state signals to provide a pulsating indication when the system noise level exceeds a certain level, indicating that the margin of safety is less than a desired value, and a steady indication when the alarm threshold is exceeded.

The objects and the various advantages of the invention will become even more apparent to those skilled in the art from the ensuing detailed description of a preferred embodiment, reference being made to the accompanying drawings.

DETAILED DESCRIPTION OF A PREFERRED EMBODIMENT

While the invention will be described with reference to a multihead ultrasonic intruder detection system, it should be understood that such a system is only exemplary of the energy-responsive systems, both active and passive, in which the invention has utility.

Figure 1:
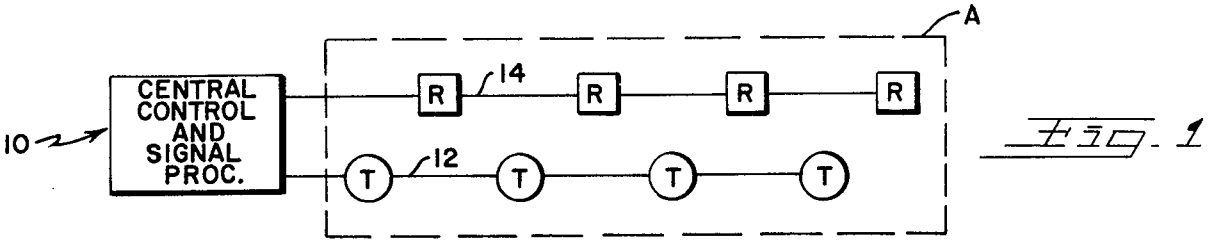
FIG. 1 is a block diagram of a multihead ultrasonic intruder detection system.

Referring now to FIG. 1, a multihead ultrasonic intruder detection system is shown to comprise a plurality of ultrasonic energy transmitters T which are arranged at various locations in an area A under surveillance. Each transmitter includes an acousto-electric transducer, such as a piezoelectric crystal, which is driven at an ultrasonic frequency (e.g., 25 KHz) by a crystal oscillator contained in a central control unit 10. A cable 12 serves to connect each transmitter T with the central control unit.

Figure 2:
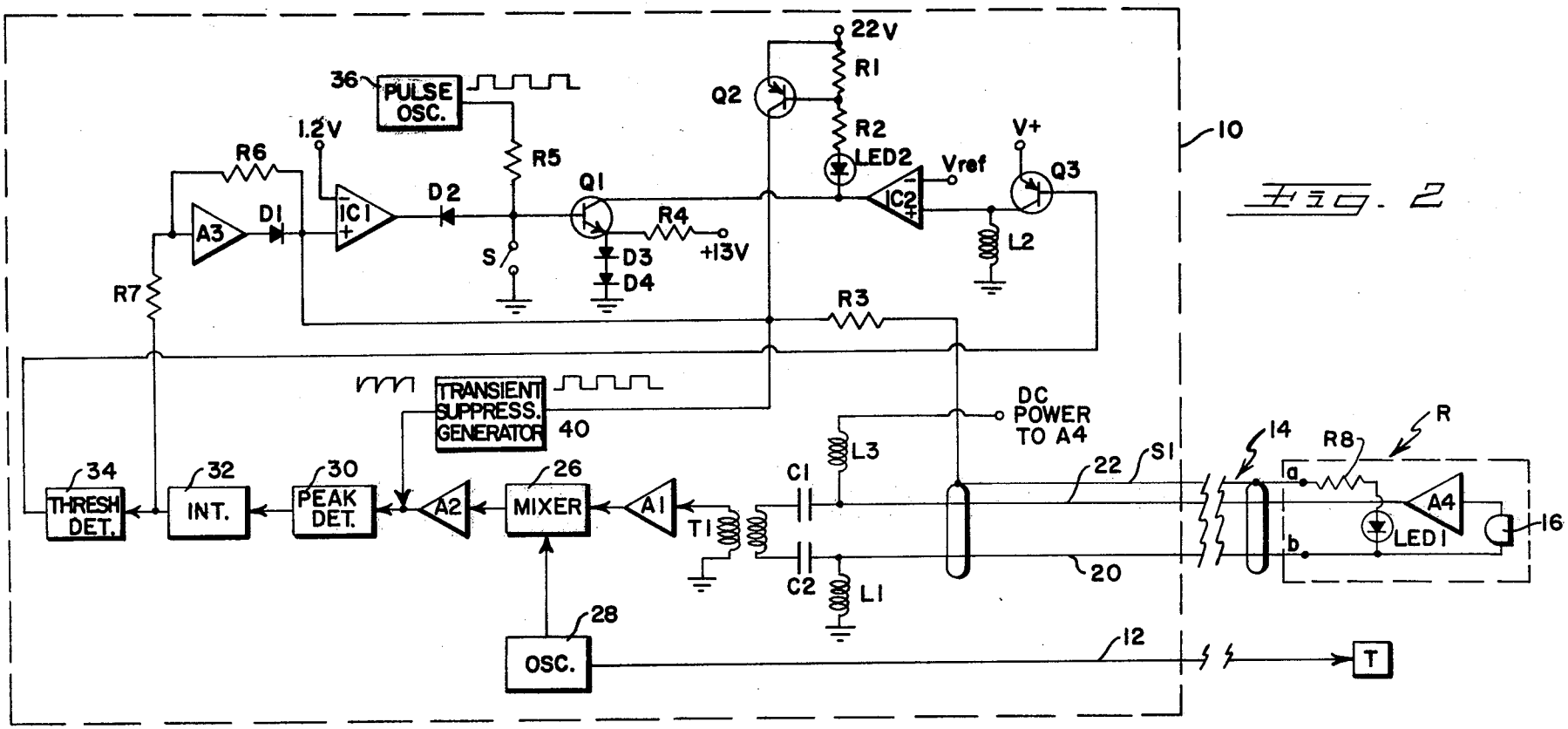
FIG. 2 is an electrical schematic of a preferred embodiment of the invention.

Arranged at various locations in area A to receive energy transmitted by transmitters T are a plurality of receivers R. Each receiver includes an acousto-electric transducer 16 (FIG. 2). for converting the received acoustical energy to an electrical signal proportional thereto. Each receiver R is connected to the central control unit by a shielded two-wire cable 14 or, more simply, a "shielded pair". As shown in FIG. 2, the receiver the transducer 16 is connected across the two wires of the shielded pair, and a conventional preamplifier A4 serves to amplify the A.C. output of the transducer prior to being transmitted back to the central control unit 10 on cable 14 for processing. D.C. power is transmitted to preamplifier A4 through an inductance L3 which isolates the D.C. power source from A.C. signals. Also, as is discussed in more detail below, each receiver R includes a selectively energizable indicator, preferably a light-emitting diode LED1, connected between the conductive shield portion of the shielded pair, and one of the two wires.

Referring now to FIG. 2, the central control unit 10 comprises signal processing circuitry for detecting, from the signal generated by the receivers, the presence of an intruder. To do this, the signals borne by the two wires, 20, 22 of the shielded pair 14 are fed to an A.C. amplifier A1 via coupling transformer T1. Capacitor C1 eliminates any D.C. signals on transformer T1. Amplifier A1 serves to amplify the 25 KC carrier signal, and the output thereof is fed to a mixer circuit 26 together with the output of the 25 KC oscillator 28 which drives the transmitters. Mixer 26 serves to isolate the Doppler signal produced by the movement of an intruder. The Doppler signal is then amplified and filtered by amplifier A2, and then fed to a peak detecting circuit 30, to convert the A.C. Doppler signal to a D.C. signal. This D.C. signal is then integrated by integrating circuit 32. When the output of integrator 32 exceeds the threshold determined by threshold detecting circuit 34, a signal is transmitted to the base of transistor Q3 which turns off, thereby dropping out the alarm relay, designated by coil L2, to sound an alarm. The aforedescribed is a preferred embodiment which may utilize conventional circuitry; see, for instance, the disclosure of U.S. Pat. No. 3,681,745 (Perlman et al) and U.S. Pat. No. 3,111,657 (Bagno) which are hereby incorporated herein by reference.

Now, according to the invention, the output of integrator 32, which, when a target is not present, represents the noise level of the system, is connected, via buffer operational amplifier A3, an isolation diode D1 and current-limiting resistor R3, to the shield portion S' of the shielded pair. Resistors R6 and R7 control the gain of amplifier A3. Thus, the system noise level can be monitored at each receiver by connecting a voltmeter between the shield S' and input lead 20, between points a and b in receiver R.

Further, according to the invention, the light-emitting diode LED1 of each receiver R is periodically energized to provide a visible pulsating indication to the system installer when the system noise becomes excessive; i.e., when it reduces the margin of safety against false alarms below a predetermined value. To provide this indication, the output of buffer amplifier A3 is connected to comparator IC1. When the output of amplifier A3 exceeds the threshold voltage of the comparator, as determined by the reference voltage (e.g., 1.2 volts) applied thereto, the output of the comparator goes positive. The threshold of comparator IC1 is set at a level which is less than that of threshold of detector 34 which determines the signal level required to activate an alarm. A positive output from comparator IC1 acts to turn diode D2 off, thereby allowing the square wave output of pulse oscillator 36 to alternately switch transistor Q1 on and off when switch S is in an open position, as shown. Diodes D3 and D4 provide a reference voltage at the emitter of transistor Q1 to insure clean switching response. Resistors R4 and R5 are current limiting resistors. When switch S is in the closed position, transistor Q1 is always off. The collector of transistor Q1 is connected to a light-emitting diode LED2 within the control unit. When transistor Q1 is switched on and off, LED2 will flash in turn, producing a voltage across resistor R1, causing transistor Q2 to turn on and off. As transistor Q2 turns on and off, a pulsating signal is transmitted via current limiting resistor R3 to shield S' and thence to the receivers. This pulsating signal causes the light-emitting diode LED1 in each receiver to flash periodically. Resistors R2 and R8 limit the current applied to LED1 and LED2, respectively. Inductance L1 serves to provide a D.C. return to ground for the signal which energizes LED1 in each receiver.

The light-emitting diode in each receiver requires a current to flow in the receiver cable 14. A transient signal at the switching rate may be observed at the receiver output. This would tend to produce an artificial background noise voltage. To compensate for this, an inhibit signal is generated by a transient suppression generator 40, such signal being applied to the peak detector 30 to nullify the switching transients in the background noise voltage. This inhibit signal is generated by differentiating the turn on and turn off voltage for LED2.

As mentioned above, when the output of integrator 32 exceeds the threshold set by threshold detector 34, as occasioned by the presence of an intruder, an alarm is sounded. An indication of this condition at the receivers is provided by connecting the collector of transistor Q2 to shield S'. When the control unit is in an alarm condition, a voltage is generated across resistor R1 which is connected across the base-emitter junction of transistor Q2. Transistor Q2 saturates through current limiting resistor R3, driving shield S' positive toward the +22 volt supply thereby providing drive voltage for the light-emitting diode LED1 in each receiver.

Comparator IC2 serves to turn on indicator LED2 and, consequently, remote indicators LED1 via the action of Q2 whenever the voltage across alarm relay L2 drops below the voltage $V_{ref}$. This condition occurs whenever the output of integrator 32 exceeds the alarm threshold.

From the foregoing, it should be apparent that an energy-responsive system is provided with certain unique features which greatly facilitates the installation procedure. Not only may the system noise level be monitored at each remote receiver, but visible signals are provided at each receiver when the noise level exceeds a desired maximum level, and when the system trips in response to detecting the event of interest. Further, these three signals are transmitted to each receiver head on the wiring necessary to transmit signals from the receiver to the control processing unit; i.e., no additional wiring is necessary.

While this invention has been described with particular reference to a preferred embodiment, various modifications will suggest themselves to those skilled in the art, without departing from the spirit and scope of this invention, as defined by the appended claims.

I claim:

1. An energy-responsive system comprising:

(a) one or more receiver units for receiving energy as modulated by the event of interest occurring within a space monitored by said system and for generating a first electrical signal proportional to the received energy, each of said receivers including a first selectively energizable indicator;

(b) a signal processing unit spaced from said receiver units; and (c) a cable connecting said receivers and signal processing unit, said cable comprising first and second wires having a conductive shield therearound, said wires serving to transmit said first electrical signal from said receiver units to said signal processing unit, said indicator being connected between said shield and said first wire within said cable;

(d) said signal processing unit comprising (i) signal processing circuitry operatively coupled to said first and second wires and operable to generate a second electrical signal having an amplitude proportional to changes in said first signal; (ii) a first threshold detecting circuit for generating an alarm signal in response to said second signal exceeding a first predetermined threshold level; (iii) a second threshold detecting circuit for generating a pulsating signal in response to said second signal exceeding a second predetermined threshold level, said second level being lower than said first threshold level; and (iiii) means connecting said second threshold detecting means to said shield for transmitting said pulsating signal to said receiver units, whereby said indicator may be periodically energized to indicate when said second signal exceeds said second threshold level.

2. The energy-responsive system defined by claim 1 further comprising means connecting said signal processing circuitry to said shield to transmit said second signal to said receiver units, whereby the amplitude of said second signal may be monitored at said receiver units.

3. The energy-responsive system defined by claim 1 further comprising means by which said indicator is operatively coupled to said first and second threshold detecting circuits to provide a pulsating indication when said second signal exceeds said second threshold level, and a steady indication when said second signal exceeds said first threshold level.

4. The energy-responsive system defined by claim 1 further comprising means for operatively coupling said first threshold detecting circuit with said shield to energize said indicator continuously when said second signal exceeds said first threshold level.

5. An energy-responsive system comprising:

a. at least one receiver unit for receiving energy as modulated by an event of interest occurring within a space monitored by said system and for generating a first output signal proportional to the received energy;

b. a signal processing unit spaced from said receiver unit; and c. a cable connecting said receiver unit and signal processing unit, said cable comprising first and second wires having a conductive shield therearound, said wires serving to transmit said first output signal from said receiver unit to said signal processing unit; said signal processing unit comprising signal processing circuitry operatively coupled to said first and second wires and operable to produce a second output signal having an amplitude proportional to said first output signal; and means connecting said signal processing circuitry to said shield for transmitting said second output signal to said receiver unit, whereby the amplitude of said second output signal is monitorable at said receiver unit.

6. The energy-responsive system of claim 5, wherein said receiver unit comprises an electrically energizable indicator connected between said shield and one of said wires comprising said cable, and wherein said signal processing unit further comprises a first threshold detecting circuit for producing a first electrical signal in response to said second output signal exceeding a first predetermined threshold level, and means connecting the first threshold detecting circuit and said shield, whereby said indicator is energized by said first electrical signal to indicate when said second output signal has exceeded said first threshold level.

7. The energy-responsive system of claim 6 wherein said signal processing unit further comprises a second threshold detecting circuit for producing a second electrical signal in response to said second output signal exceeding a second predetermined threshold level, said second threshold level being lower than said first threshold level, and means connecting said second threshold detecting circuit and said shield, whereby said indicator will be energized by said second electrical signal when said second output signal exceeds said second threshold level, and by said first electrical signal when said second output signal exceeds said first threshold level.

8. An energy-responsive system comprising:

a. at least one receiver unit for receiving energy as modulated by the event of interest occurring within a space monitored by said system and for generating a first output signal proportional to the received energy, each of said receivers including an electrically energizable indicator;

b. a signal processing unit spaced from said receiver unit; and c. a cable connecting said receiver unit and signal processing unit, said cable comprising first and second wires having a conductive shield therearound, said wires serving to transmit said first output signal from said receiver unit to said signal processing unit, said indicator being connected between said shield and said first wire within said cable;

said signal processing unit comprising (i) signal processing circuitry operatively coupled to said first and second wires and operable to generate a second output signal having an amplitude proportional to said first output signal; (ii) a first threshold detecting circuit for generating a first signal in response to said output signal exceeding a first predetermined threshold level; (iii) a second threshold detecting circuit for generating a second signal in response to said second output signal exceeding a second predetermined threshold level, said second level being lower than said first threshold level; and (iiii) means connecting said first and second threshold detecting means to said shield for energizing said indicator by said second signal when said second output signal exceeds said second threshold level, and for energizing said indicator by said first signal when said second output signal exceeds said first threshold level.

* * * * *